US005492299A

United States Patent [19]

Thermos et al.

[11] Patent Number: 5,492,299

[45] Date of Patent: Feb. 20, 1996

[54] BOOKSTAND

[76] Inventors: Nicholas Thermos, 859 S. Alkire St., Lakewood, Colo. 80228; John P. Cleveland, 7074 Dover Way, Arvada, Colo. 80004

[21] Appl. No.: 329,888

[22] Filed: Oct. 27, 1994

[51] Int. Cl.[6] ..... A47B 97/04

[52] U.S. Cl. ..... 248/453; 248/456; 248/465

[58] Field of Search ..... 248/453, 451, 248/454, 455, 459, 460, 174, 176, 371, 452, 463, 465, 432, 434

[56] References Cited

U.S. PATENT DOCUMENTS

| | | | |
|---|---|---|---|
| 411,482 | 9/1889 | Wootton | 248/455 X |
| 1,220,705 | 3/1917 | Tayte | 248/453 |
| 1,564,594 | 12/1925 | Leh | 248/451 X |
| 1,790,487 | 1/1931 | Ruhnau | 248/448 |
| 2,374,409 | 4/1945 | Brennan | 248/253 |
| 3,031,795 | 5/1962 | Frost | 248/452 |
| 4,043,530 | 8/1977 | May | 248/453 |
| 4,123,029 | 10/1978 | Gillotti | 248/453 |
| 4,886,231 | 12/1989 | Doerksen | 248/455 |

*Primary Examiner*—J. Franklin Foss
*Attorney, Agent, or Firm*—Thomas C. Naber

[57] ABSTRACT

The present invention is a bookstand for a book. The bookstand comprises a back panel having a top, a bottom, a front side against which a book can rest and a back side. Projecting outwardly from substantially the bottom of the back panel is a lip panel upon which a book can be placed. The lip panel has projectable therefrom a plurality of page retainers for maintaining interfacing book pages open, with each page retainers having a distal end movable toward the back panel. Such movement of one page retainers is independent of movement of another page retainers, thereby allowing positioning of one page retainers near one interfacing page of an open book and positioning of another page retainers near the other interfacing facing page. In a preferred embodiment, each page retainers comprises a rod having a distal end and a proximal end. The proximal end of the rod is hingedly connected to the lip panel in a plane substantially perpendicular to the back panel to thereby rotate on the hinge for movement of the distal end of the rod toward the back panel.

6 Claims, 2 Drawing Sheets

BOOKSTAND

BACKGROUND OF THE INVENTION

I. Field of the Invention

This invention relates in general to a bookstand, and in particular to a bookstand having page retainer means projectable from an outwardly extending lower lip panel and movable toward a back panel to thereby maintain open and in place facing pages of an open book situated on the bookstand.

II. Description of the Prior Art

Present bookstands are available in a variety of designs depending upon the applicability of the situation in which a book is to be supported. For example, a library may provide a pedestal-type bookstand rising from the floor and upon which a book is placed, while a college student may have a desktop backboard against which an open book can lean. While present bookstands provide a site for book placement, they generally lack any type of provision for maintaining the book in an open position at a selected page. As most readers have experienced, many books tend to exhibit a "page-turning" proclivity whereby the book will not remain opened at the desired page. Instead, many times one to five pages or more seem to automatically turn, thus necessitating active page retention by the reader. One prior art bookstand provides a pair of spaced cylinders projecting upwardly from an outwardly projecting lower lip upon which a book resides. Although these cylinders are in front of the open pages of a book placed on the lip, the cylinders are not movable toward the open pages to thereby be closer to the pages for effective page retention. As a result, pages of a book that are not relatively close to a cylinder can still turn since they simply brush past the cylinder.

In view of the above, it is apparent that a bookstand that functions to retain open pages in their open configuration is needed. Accordingly, a primary object of the present invention is to provide a bookstand wherein integral page retainer means are movable toward open interfacing pages to maintain them in the open position.

Another object of the present invention is to provide a bookstand wherein the page retainer means are projectable from an outwardly projecting lip thereof and upon which a book is placed for reading.

Yet another object of the present invention is to provide a bookstand that is angularly adjustable to thereby position a book thereon at a comfortable angle according to a reader's needs.

These and other objects of the present invention will become apparent throughout the description thereof which now follows.

SUMMARY OF THE INVENTION

The present invention is a bookstand for a book. The bookstand comprises a back panel having a top, a bottom, a front side against which a book can rest and a back side. Projecting outwardly from substantially the bottom of the back panel is a lip panel upon which a book can be placed. The lip panel has projectable therefrom a plurality of page retainer means, with each page retainer means having a distal end movable toward the back panel. Such movement of one page retainer means is independent of movement of another page retainer means, thereby allowing positioning of one page retainer means near one page of an open book and positioning of another page retainer means near the facing page thereof.

In a preferred embodiment, each page retainer means comprises a rod having a distal end and a proximal end. The proximal end of the rod is hingedly connected to the lip panel in a plane substantially perpendicular to the back panel to thereby rotate on the hinge for movement of the distal end of the rod toward the back panel. It is preferable to have two page retainer means disposed laterally from each other and substantially equidistant from a midline of the lip panel. As is apparent, the present invention accomplishes the task of allowing a reader to maintain interfacing pages of a book in an open position on a bookstand without having to use his or her hands or other objects to retain the respective pages in place. The back side of the back panel preferably has disposed thereon prop means than are angularly adjustable to thereby position the bookstand at a selected angle on a surface on which the bookstand is placed.

BRIEF DESCRIPTION OF THE DRAWINGS

An illustrative and presently preferred embodiment of the invention is shown in the accompanying drawings in which.

DETAILED DESCRIPTION OF PREFERRED EMBODIMENTS

Figure 1:
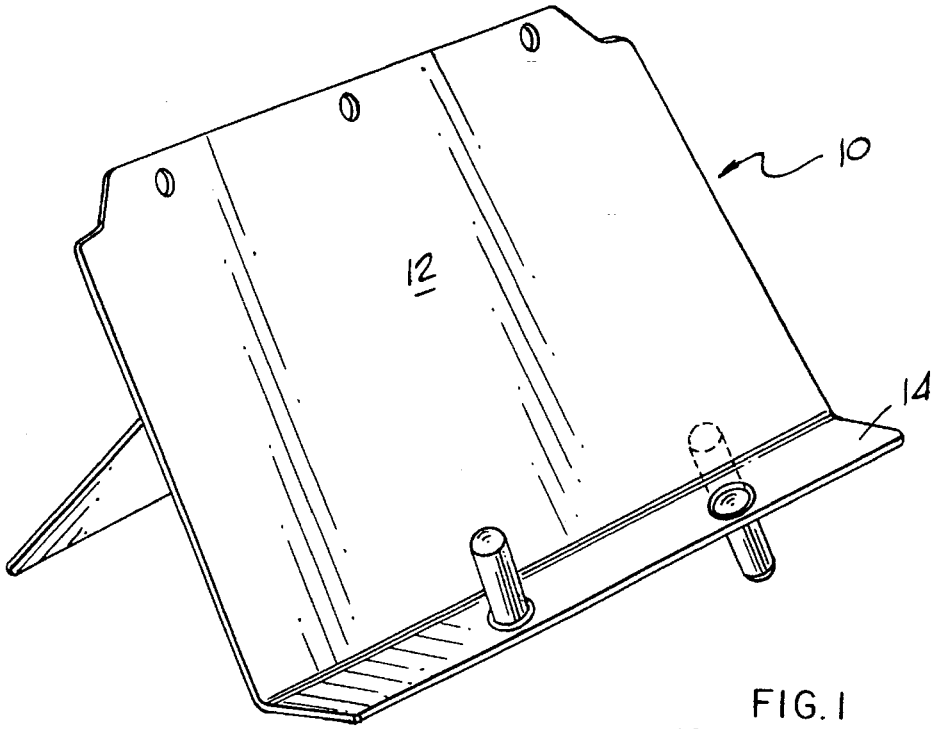
FIG. 1 (Prior Art)
FIG. 1 is a front perspective view of a prior art bookstand.

The present invention is a bookstand for retaining facing pages of a book in place while a user reads or otherwise refers to those pages. FIG. 1 illustrates a prior art bookstand 10 having a back panel 12 and a lip panel 14. Disposed by friction fit through the lip panel 14 are two cylinders 16, 18 that project upwardly (as shown in solid and phantom lines) from the lip panel 14. While the cylinders 16, 18 can retain facing pages of a relatively thick book in an open position, the cylinders 16, 18 are not movable toward the back panel 12. Consequently, when only a thin stack of pages of a book is presented, the cylinders 16, 18 are not close enough to the exposed pages and thus can be ineffective in retaining those pages in an open configuration.

Figure 2:
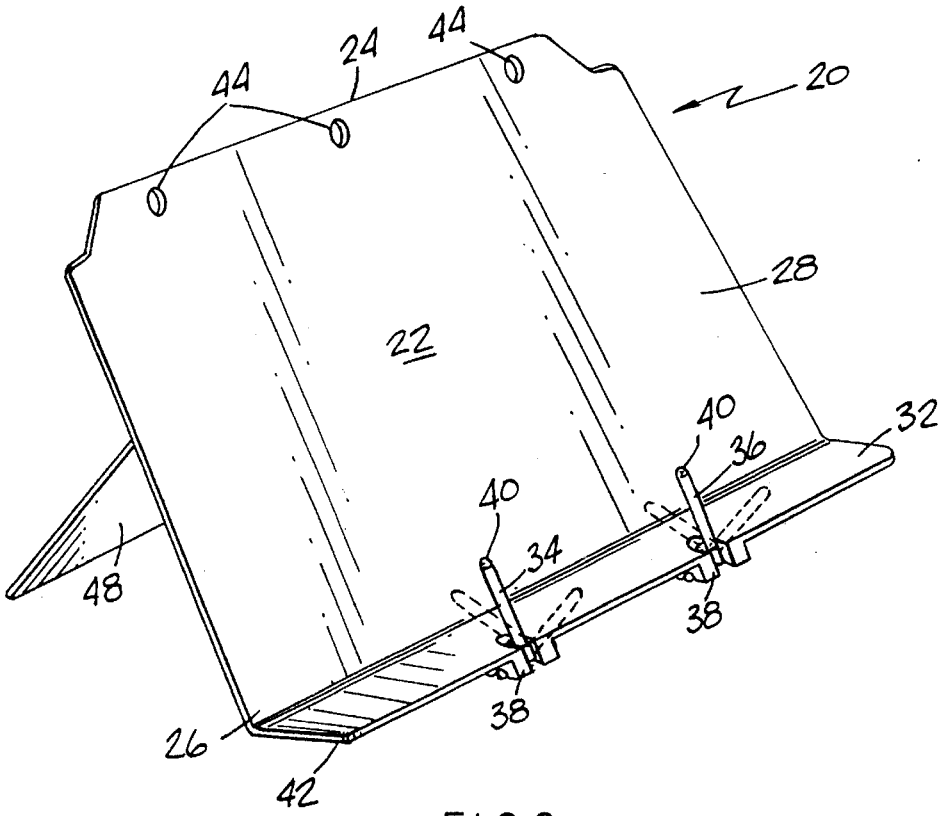
FIG. 2 is a front perspective view of a bookstand of the present invention.
Figure 3:
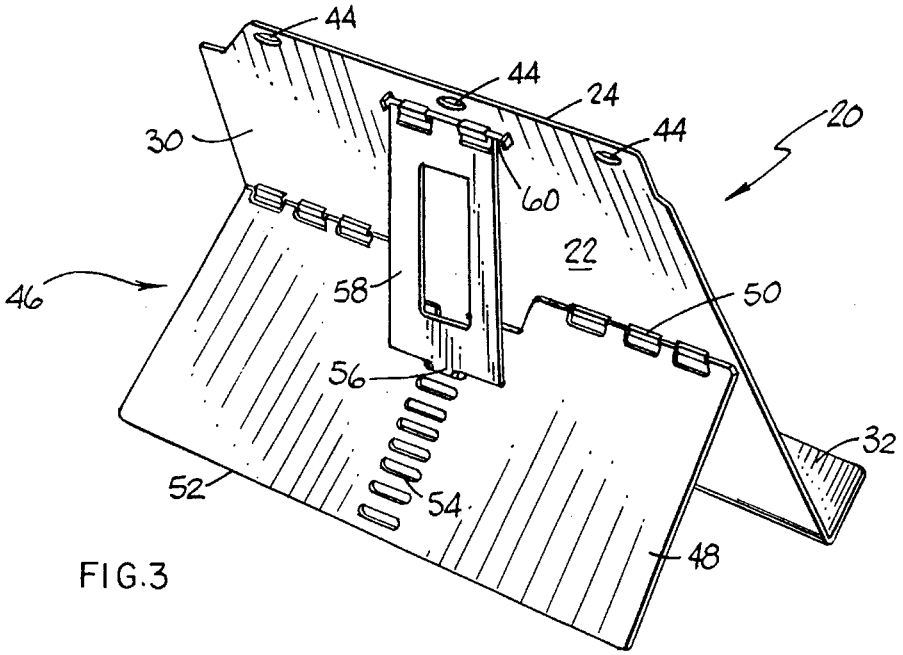
FIG. 3 is a rear perspective view of the bookstand of FIG. 2.

Referring to FIGS. 2 and 3, a preferred embodiment of the present invention is shown. Specifically, the inventive bookstand 20 comprises a back panel 22 having a top 24, a bottom 26, a front side 28 and a back side 30. A lip panel 32 projects outwardly from the bottom 26 of the back panel 20 at substantially a 90° angle. In the preferred embodiment, the back panel 22 and lip panel 30 are constructed of a single piece of material which is preferably high-impact polystyrene, but can, of course, be any appropriate material that will function in accord with the utility of the invention. Likewise, the back and lip panels can be two separate pieces joined together either in a stationary manner or hingedly to fold flat, as would be accomplishable by a skilled artisan. Disposed at the leading edge of the lip panel 32 and projectable therefrom are two rods 34, 36 situated laterally from each other and substantially equidistant from a midline of the lip panel 32. The proximal ends of each of the rods 34, 36 are hingedly attached to the lip panel 32 via press-fit hinge means 38 as known in the art. The rods 34, 36 rotate (as shown in phantom lines) about the hinge means 38 such that the distal ends 40 thereof are movable toward the back panel 22. When not in use, the rods 34, 36 can be rotated from a projecting configuration to be flatly adjacent the outside bottom 42 of the lip panel 32.

Referring in particular to FIG. 3, the back side 30 of the back panel 22 has disposed thereon prop means generally designated 46 to provide angular adjustability as well as collapsibility of the bookstand 20. The prop means 46 includes a plate 48 hingedly attached to the back side 30 of the back panel 22 via press-fit hinge means 50. The bottom edge 52 of the plate 48 resides on the surface on which the bookstand 20 is situated and is rotated to adjust the angle at which the back panel 22 supports a book. Disposed along the midline of the plate 48 are a plurality of oval openings 54 shaped to accept a tab 56 of a keeper bar 58 hingedly attached via press-fit hinge means 60 to the back side 30 of the back panel 22. As is apparent from FIG. 3, when a user positions the plate 48 at a desired configuration to coincide with a desired angle of the back panel 22, the keeper bar 58 is rotated to place the tab 56 thereof in an appropriate opening 54 and thereby maintain angular stability. When not in use, the plate 48 and the keeper bar 58 can be rotated to be flatly adjacent the back side 30 of the back panel 22.

The top 24 of the back panel 22 has there through a sufficient number (e.g. three, as shown) of openings 44 spaced to accommodate a plurality of rings of a ring binder (not shown). Collapsing the bookstand 20 by rotating the plate 48, keeper bar 58, and rods 34, 36 to be flatly adjacent respective surfaces as described above permits a user to conveniently and easily store and carry the bookstand 20 in a ring-binder notebook such as those commonly used by students.

Figure 4:
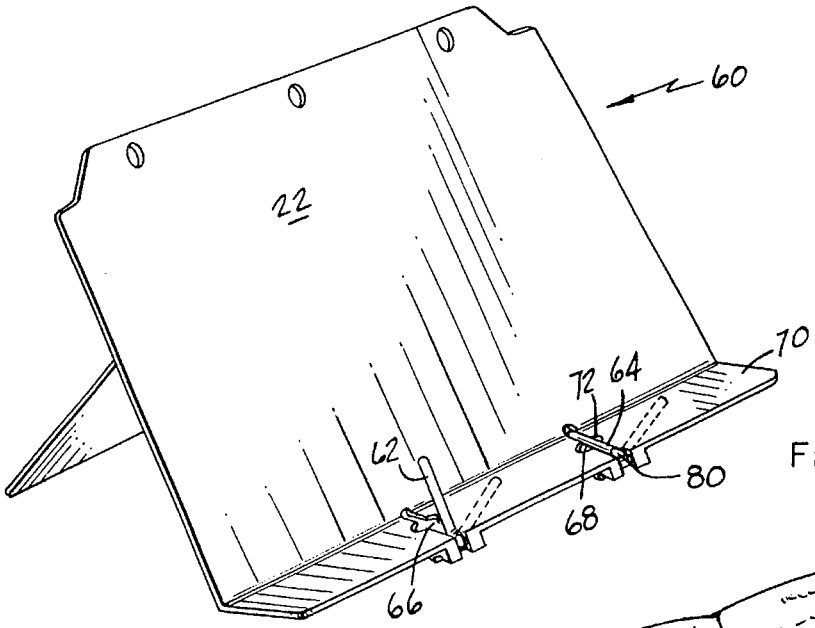
FIG. 4 is a front perspective view of a second embodiment of a bookstand of the present invention.
Figure 5:
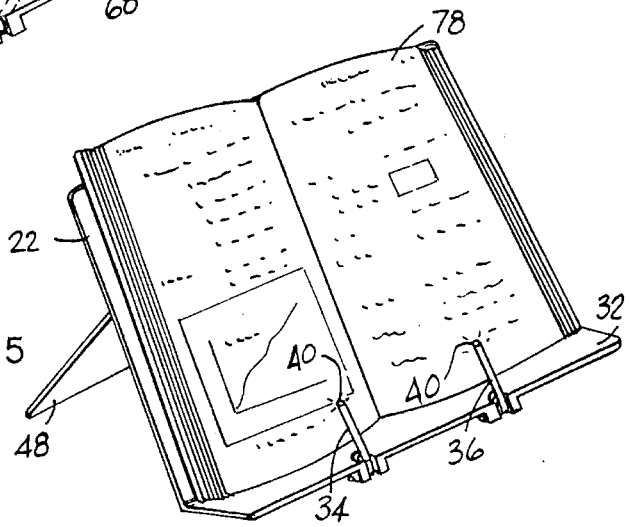
FIG. 5 is a front elevation view of the bookstand of FIG. 2 with a book in place.

FIG. 4 illustrates a second embodiment of a bookstand 60 whose only difference from the bookstand 20 of FIGS. 2, 3 and 5 is the rotatability of the rods 62, 64. Specifically, the rods 62, 64 are rotatable (as shown in phantom lines) 360° through appropriately disposed and sized openings 66, 68 through the lip panel 70. Each of the openings 66, 68 is preferably provided with a widened cut-out 72 for easier finger placement to accomplish rod rotation. Provision of a 360° rotation allows the distal ends of the rods 62, 64 to actually contact as little as a single sheet of paper supported on the bookstand 60. In all other respects, the bookstand 60 of FIG. 4 is identical to the bookstand 20 of FIGS. 2, 3 and 5. The top and bottom of the proximal tip area of each of the rods 34, 36, 62, 64 is provided with a flattened region 80, as illustrated on rod 64 of FIG. 4, which functions to prohibit lateral movement of the rods within the press-fit hinge means 38.

Operation of the bookstand 20 is illustrated in FIG. 5. In particular, a book 78 is placed on the lip panel 32 and rests against the back panel 22. The plate 48 is adjusted to reflect a desired angle for book placement. After opening the book 78 to a desired location, the distal ends 40 of the rods 34, 36 are moved toward the book 78 to thereby retain the exposed interfacing pages in an open position. As is apparent, as the stack of pages to the left side or to the right side of the opened book increases or decreases after a series of page turns, the distal ends 40 of the independently rotatable rods 34, 36 are still positionable against or in close proximity to the then-exposed interfacing pages as the respective stack thicknesses change.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

We claim:

1. A bookstand comprising:

a) a back panel having a top, a bottom, a front side against which a book can rest and a back side;

b) a lip panel having a leading edge and projecting outwardly from substantially the bottom of the front side of the back panel and upon which a book can be placed;

c) a plurality of page retainer means each comprising a rod having a distal end and a proximal end, with said proximal end hingedly connected by a hinge to the lip panel at the leading edge of the lip panel to thereby be rotatable on said hinge for movement of the distal end toward the back panel independent of movement of another rod; and d) an angularly adjustable prop means disposed on the back side of the back panel for positioning the bookstand at a selected angle on a surface, the prop means comprising a plate hingedly attached by a hinge to the back side of the back panel between the top and bottom of the back panel, said plate having a bottom edge and having a plurality of openings disposed along its length, said prop means further comprising a keeper bar hingedly attached by a hinge to the back side of the back panel above the plate and having a tab acceptable within any opening of the plurality of openings to thereby maintain an angle and angular stability of the plate as the bottom edge of the plate resides on a surface.

2. A bookstand as claimed in claim 1 having two page retainer means disposed laterally from each other and substantially equidistant from a midline of the lip panel.

3. A bookstand as claimed in claim 2 wherein the lip panel has there through a respective opening for each respective page retainer means through which said page retainer means can travel during rotation thereof to thereby be rotatable 360°.

4. A bookstand as claimed in claim 3 wherein the top of the back panel has there through a sufficient number of openings spaced to accommodate a plurality of rings of a ring binder.

5. A bookstand as claimed in claim 1 wherein the lip panel has there through a respective opening for each respective page retainer means through which said page retainer means can travel during rotation thereof to thereby be rotatable 360°.

6. A bookstand as claimed in claim 1 wherein the top of the back panel has there through a sufficient number of openings spaced to accommodate a plurality of rings of a ring binder.

* * * * *